US012326270B2

(12) United States Patent
Nagai et al.

(10) Patent No.: US 12,326,270 B2
(45) Date of Patent: Jun. 10, 2025

(54) AIR CONDITIONER

(71) Applicant: CARRIER JAPAN CORPORATION, Tokyo (JP)

(72) Inventors: Hiroyuki Nagai, Shizuoka (JP); Ken Miura, Shizuoka (JP); Irvan Brata Tarigan, Shizuoka (JP)

(73) Assignee: CARRIER JAPAN CORPORATION, Tokyo (JP)

( * ) Notice: Subject to any disclaimer, the term of this patent is extended or adjusted under 35 U.S.C. 154(b) by 181 days.

(21) Appl. No.: 18/245,090

(22) PCT Filed: Aug. 25, 2021

(86) PCT No.: PCT/JP2021/031243
§ 371 (c)(1),
(2) Date: Mar. 13, 2023

(87) PCT Pub. No.: WO2022/054584
PCT Pub. Date: Mar. 17, 2022

(65) Prior Publication Data

US 2023/0358432 A1 Nov. 9, 2023

(30) Foreign Application Priority Data

Sep. 14, 2020 (JP) ..... 2020-154116

(51) Int. Cl.
*F24F 11/84* (2018.01)
*F24F 1/0059* (2019.01)

(52) U.S. Cl.
CPC ..... *F24F 11/84* (2018.01); *F24F 1/0059* (2013.01)

(58) Field of Classification Search
CPC ..... F24F 11/84; F24F 1/0059
See application file for complete search history.

(56) References Cited

U.S. PATENT DOCUMENTS

2009/0056358 A1 3/2009 Kotani et al.
2015/0020535 A1 1/2015 Hatomura et al.
(Continued)

FOREIGN PATENT DOCUMENTS

JP 2000266388 A * 9/2000
JP 2007-218558 8/2007
(Continued)

OTHER PUBLICATIONS

Inoue, Controller and Control Method for Multi-Type Refrigeration Cycle System, 2000, Full Document (Year: 2000).*
(Continued)

*Primary Examiner* — Nael N Babaa
(74) *Attorney, Agent, or Firm* — DLA Piper LLP (US)

(57) ABSTRACT

An air conditioner that has a controller and is such that an outdoor unit, which is provided with a compressor, an outdoor heat exchanger, an accumulator, and a supercooling heat exchanger, and indoor units provided with indoor heat exchangers, are connected to each other by connecting piping to constitute a refrigerant circuit. The bottom of the accumulator is connected to an intake side of the compressor via return bypass piping that is provided with an electromagnetic valve. The cooling source for the supercooling heat exchanger is a supercooling bypass circuit provided with a supercooling expansion valve; and when the amount of refrigerant during heating operation is determined to be excessive, the controller performs a control so as to fully close the electromagnetic valve of the return bypass piping and to gradually increase the opening degree of the supercooling expansion valve of the supercooling bypass circuit from a fully closed state.

2 Claims, 3 Drawing Sheets

(56) References Cited

U.S. PATENT DOCUMENTS

| | | | |
|---|---|---|---|
| 2016/0273795 | A1 | 9/2016 | Takenaka et al. |
| 2021/0348815 | A1 | 11/2021 | Yamada et al. |

FOREIGN PATENT DOCUMENTS

| | | | |
|---|---|---|---|
| JP | 2020-085269 | | 6/2020 |
| WO | WO 2013/160967 | | 10/2013 |
| WO | 2015059945 | A1 | 4/2015 |
| WO | 2020066924 | A1 | 4/2020 |

OTHER PUBLICATIONS

Extended European Search Report for European Application No. 21866544.6, mailed Aug. 22, 2024, 10 pages.
International Search Report in Application No. PCT/JP2021/031243, dated Oct. 5, 2021.
Written Opinion in Application No. PCT/JP2021/031243, dated Oct. 5, 2021.

* cited by examiner

AIR CONDITIONER

CROSS REFERENCE TO RELATED APPLICATIONS

This application claims the benefit of priority of No. PCT/JP2021/031243, filed on Aug. 25, 2021, and the PCT application is based upon and claims the benefit of priority from Japanese Patent Application No. 2020-154116 filed on Sep. 14, 2020, the entire contents of each of which are incorporated herein by reference.

TECHNICAL FIELD

Embodiments of the present invention relate to an air conditioner in which an outdoor unit and a plurality of indoor units are connected.

BACKGROUND

In an air conditioner disclosed in Patent Document 1, as a method of storing liquid in an accumulator when an excessive refrigerant is detected, a technique of storing the excessive refrigerant in an accumulator of an outdoor unit in operation and an accumulator of a stopped outdoor unit is disclosed.

PRIOR ART DOCUMENT

Patent Document

[Patent Document 1] JP 2007-218558 A

SUMMARY

Problems to be Solved by Invention

However, the refrigerant stored in the accumulator of the outdoor unit in operation has a possibility of being discharged immediately after being stored. Moreover, the refrigerant stored in the accumulator of the stopped outdoor unit cannot be recovered until this stopped outdoor unit is restarted. Thus, when the operating state of the air conditioner changes and thereby the appropriate amount of the refrigerant also changes, it may cause a problem such as: decrease in heating performance due to excessive amount of the refrigerant or insufficient amount of the refrigerant; and unnecessary power consumption caused by restarting the stopped outdoor unit for resolving the refrigerant shortage.

In view of the above-described circumstances, an object of embodiments of the present invention is to provide an air conditioner that ensures satisfactory heating performance by appropriately adjusting amount of refrigerant in a refrigerant circuit during heating operation.

Means for Solving Problem

An air-conditioner in accordance with an aspect of the present invention in which a controller and a refrigerant circuit are provided and the refrigerant circuit is configured by connecting: an outdoor unit including a compressor, an outdoor heat exchanger, an accumulator, and a supercooling heat exchanger; and a plurality of indoor units each including indoor heat exchanger via connecting piping, wherein: the accumulator is connected to a suction side of the compressor, and a bottom portion of the accumulator is connected to a suction side of the compressor via return bypass piping that has a valve; the outdoor heat exchanger and the supercooling heat exchanger are sequentially connected to a discharge side of the compressor, a cooling source of the supercooling heat exchanger is a supercooling bypass circuit provided with a supercooling expansion mechanism, the supercooling bypass circuit is configured to expand a refrigerant on a downstream side of the outdoor heat exchanger by the supercooling expansion mechanism, lead the refrigerant to the supercooling heat exchanger, and then lead the refrigerant to the accumulator; and when amount of the refrigerant in the refrigerant circuit is determined to be excessive during heating operation, the controller is configured to fully close the valve of the return bypass piping and gradually increase opening degree of the supercooling expansion mechanism of the supercooling bypass circuit from a fully closed state.

Effects of Invention

According to embodiments of the present invention, amount of refrigerant in a refrigerant circuit is appropriately adjusted during heating operation and thereby satisfactory heating performance can be ensured.

DETAILED DESCRIPTION

Hereinbelow, embodiments of the present invention will be described by referring to the accompanying drawings.

Figure 1:
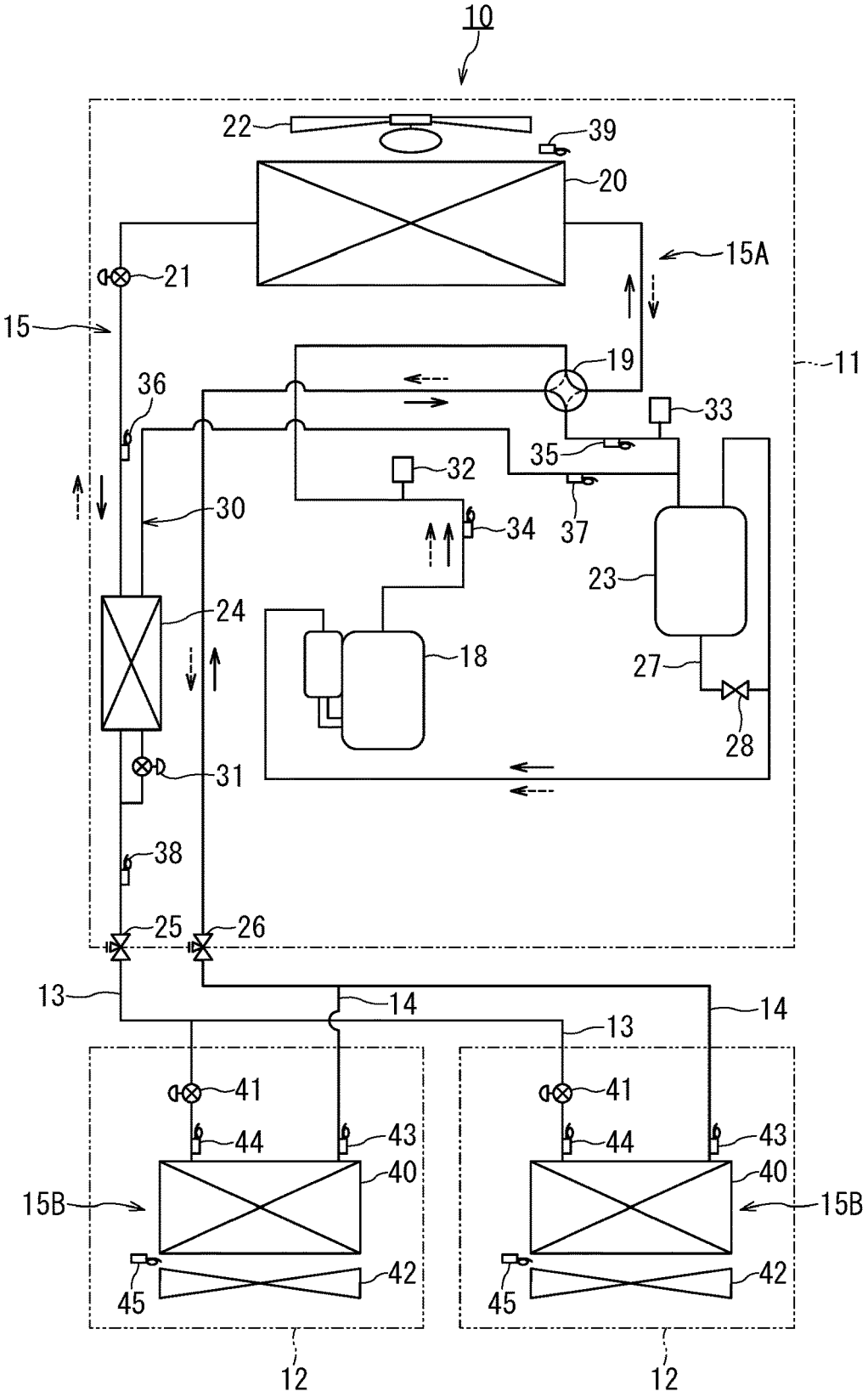
FIG. 1 is a system diagram illustrating a configuration of an air conditioner according to one embodiment.

In the air conditioner 10 shown in FIG. 1, an outdoor unit 11 and a plurality of indoor units 12 are connected by liquid refrigerant connecting piping 13 and gas refrigerant connecting piping 14 as interconnecting pipes so as to constitute a refrigerant circuit 15, and a controller 16 (FIG. 2) is further provided.

The outdoor unit 11 has an outdoor refrigerant circuit 15A that constitutes part of the refrigerant circuit 15. This outdoor refrigerant circuit 15A includes: a compressor 18; a four-way valve 19; an outdoor heat exchanger 20; an outdoor expansion valve 21 as an outdoor expansion mechanism; an outdoor fan 22; an accumulator 23; a supercooling heat exchanger 24; a liquid-side packed valve 25; and a gas-side packed valve 26.

The compressor 18 is a variable operating capacity type driven by a motor, and rotational speed of which is controlled by an inverter 46 described below.

The four-way valve 19 is a valve configured to switch the flow of the refrigerant in such a manner that the outdoor heat exchanger 20 functions as a condenser and each indoor heat exchanger 40 (described below) functions as an evaporator during cooling operation. During the cooling operation as shown by the solid line in FIG. 1, the four-way valve 19 connects the discharge side of the compressor 18 to the gas side of the outdoor heat exchanger 20 and also connects the suction side of the compressor 18 (i.e., the accumulator 23) to the gas-side packed valve 26 (i.e., the gas refrigerant connecting piping 14). During heating operation, the four-way valve 19 causes each indoor heat exchanger 40 to function as a condenser and also causes the outdoor heat exchanger 20 to function as an evaporator. During the heating operation as shown by the broken line in FIG. 1, the four-way valve 19 connects the discharge side of the compressor 18 to the gas-side packed valve 26 (i.e., the gas refrigerant connecting piping 14) and also connects the suction side of the compressor 18 to the gas side of the outdoor heat exchanger 20.

The outdoor heat exchanger 20 being composed of heat transfer pipes and many fins functions as a condenser during the cooling operation, and functions as an evaporator during the heating operation as described above. The gas side of this outdoor heat exchanger 20 is connected to the four-way valve 19, and the liquid side of this outdoor heat exchanger 20 is connected to the liquid-side packed valve 25 (i.e., the liquid refrigerant connecting piping 13).

The outdoor expansion valve 21 adjusts the amount of refrigerant flowing into the outdoor heat exchanger 20 in order to adjust the pressure and/or flow rate of the refrigerant flowing inside the outdoor refrigerant circuit 15A, and is connected to the liquid side of the outdoor heat exchanger 20. This outdoor expansion valve 21 is preferably an electronic expansion valve, which opening degree can be readily adjusted.

The outdoor fan 22 sucks the outside air into the outdoor unit 11 so as to cause the outside air to exchange heat with the refrigerant in the outdoor heat exchanger 20, and then discharges it to the outside of the outdoor unit 11. This outdoor fan 22 is a fan that can change the air volume of the outside air to be supplied to the outdoor heat exchanger 20.

The accumulator 23 is connected to the suction side of the compressor 18 between the four-way valve 19 and the compressor 18, and is a container that stores the excessive refrigerant generated in the refrigerant circuit 15. This accumulator 23 separates the liquid refrigerant and the gas refrigerant, and causes the compressor 18 to suck only the gas refrigerant. In addition, the bottom portion of the accumulator 23 is connected to the suction side of the compressor 18 via return bypass piping 27 that has an electromagnetic valve 28 as a valve mechanism. Liquid mixture of oil and the refrigerant stored in the bottom portion of the accumulator 23 is sucked into the compressor 18 through the return bypass piping 27, and the flow of the liquid mixture is controlled by opening and closing of the electromagnetic valve 28.

In the outdoor unit 11, the four-way valve 19, the outdoor heat exchanger 20, the outdoor expansion valve 21, and the supercooling heat exchanger 24 are sequentially connected to the discharge side of the compressor 18. Among these components, the supercooling heat exchanger 24 cools the refrigerant condensed in the outdoor heat exchanger 20, and a cooling source of this supercooling heat exchanger 24 is a supercooling bypass circuit 30. This supercooling bypass circuit 30 includes a supercooling expansion valve 31 as a supercooling expansion mechanism. The supercooling bypass circuit 30 causes part of the refrigerant flowing from the outdoor heat exchanger 20 to the indoor expansion valve 41 via the supercooling heat exchanger 24 to branch on the downstream side of the outdoor heat exchanger 20 (for example, on the downstream side of the supercooling heat exchanger 24), and to be expended and decompressed by the supercooling expansion valve 31, then this decompressed refrigerant is lead to the supercooling heat exchanger 24, and then to the accumulator 23. The refrigerant flowing in the supercooling heat exchanger 24 from the outdoor heat exchanger 20 toward the indoor expansion valve 41 of the indoor unit 12 is cooled by heat exchange with the refrigerant flowing through the supercooling bypass circuit 30 to be decompressed by the supercooling expansion valve 31 and lead to the supercooling heat exchanger 24.

The liquid-side packed valve 25 is a valve provided at a connection port connecting the liquid refrigerant connecting piping 13 that is piping outside the outdoor unit 11, and is connected to the supercooling heat exchanger 24. The gas-side packed valve 26 is a valve provided at a connection port connecting the gas refrigerant connecting piping 14 that is piping outside the outdoor unit 11, and is connected to the four-way valve 19.

The outdoor unit 11 is provided with various sensors. In detail, a discharge pressure sensor 32 configured to measure discharge pressure PD and a discharge temperature sensor 34 configured to measure discharge temperature TD are provided on the discharge side of the compressor 18. On the upstream of the accumulator 23 provided on the suction side of the compressor 18, a suction pressure sensor 33 configured to measure suction pressure PS and a suction temperature sensor 35 configured to measure suction temperature TS1 are provided.

A liquid-side temperature sensor 36 configured to measure liquid refrigerant temperature TL1 flowing in and out of the outdoor heat exchanger 20 is provided on the liquid side of the outdoor heat exchanger 20. The supercooling bypass circuit 30 is provided with a supercooling bypass temperature sensor 37 that measures refrigerant temperature TS2 on the outlet side of the supercooling heat exchanger 24. Further, a liquid pipe temperature sensor 38 configured to measure liquid pipe temperature TL2 is provided between the supercooling heat exchanger 24 and the liquid-side packed valve 25. Moreover, an outside air temperature sensor 39 configured to measure outside air temperature TG is provided on the suction side of the outdoor heat exchanger 20 that sucks in the outside air.

Each of the plurality of indoor units 12 has an indoor refrigerant circuit 15B that constitutes part of the refrigerator circuit 15. Each indoor refrigerant circuit 15B includes the indoor heat exchanger 40, the indoor expansion valve 41 as an indoor expansion mechanism, and an indoor fan 42.

The indoor heat exchanger 40 is a heat exchanger composed of heat transfer pipes and many fins, functions as an evaporator during the cooling operation so as to cool the indoor air, and functions as a condenser during the heating operation so as to heat the indoor air.

The indoor expansion valve 41 adjusts the amount of the refrigerant flowing into the indoor heat exchanger 40 in order to adjust, for example, the flow rate of the refrigerant flowing inside the indoor refrigerant circuit 15B, and is connected to the liquid side of the indoor heat exchanger 40. The adjustment of the amount of the refrigerant flowing into the indoor heat exchanger 40 using the indoor expansion valve 41 is achieved by controlling the opening degree of the indoor expansion valve 41 on the basis of difference between indoor supercooling degree SC and target indoor supercooling degree SCO, as described below. This indoor expansion valve 41 is preferably an electronic expansion valve, which opening degree can be readily adjusted.

The indoor fan 42 sucks the indoor air into the indoor unit 12, causes the sucked air to exchange heat with the refrigerant in the indoor heat exchanger 40, and then supplies it indoors. In addition, each indoor unit 12 is provided with various sensors.

In detail, an indoor gas-side temperature sensor 43 configured to measure gas refrigerant temperature TC1 of the indoor heat exchanger 40 is provided on the gas side of the indoor heat exchanger 40. An indoor liquid-side temperature sensor 44 configured to measure liquid refrigerant temperature TC2 of the indoor heat exchanger 40 is provided on the liquid side of the indoor heat exchanger 40. Further, an indoor air temperature sensor 45 configured to measure temperature TA of the indoor air flowing into the indoor unit 12 (i.e., indoor air temperature TA) is provided on the suction side of the indoor heat exchanger 40 that sucks in the indoor air.

In the outdoor unit 11 and the indoor units 12 described above, the compressor 18, the four-way valve 19, the outdoor heat exchanger 20, the outdoor expansion valve 21, and the supercooling heat exchanger 24 of the outdoor unit 11, as well as the indoor expansion valve 41 and the indoor heat exchanger 40 of each indoor unit 12, and the accumulator 23 of the outdoor unit 11 are sequentially connected by the refrigerant piping so as to constitute a refrigeration cycle.

Figure 2:
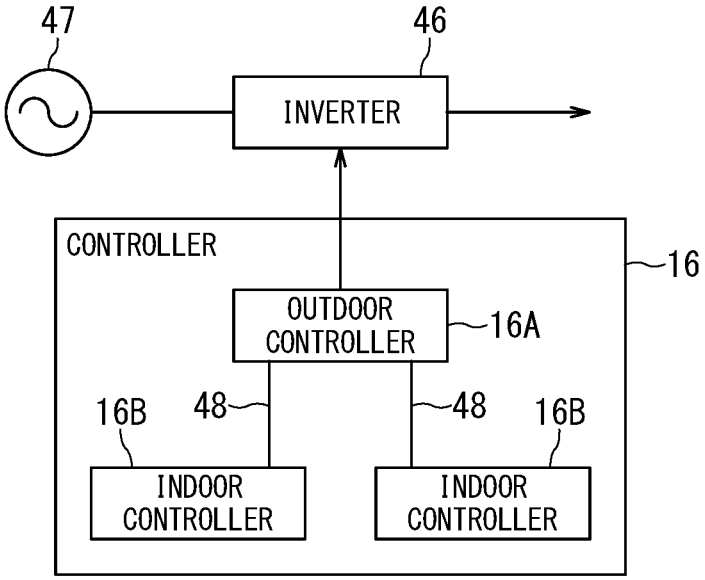
FIG. 2 is a block diagram illustrating a controller in the air conditioner in FIG. 1.

In addition, the outdoor unit 11 includes an outdoor controller 16A (FIG. 2) configured to control the operation of each component that constitutes the outdoor unit 11. Each indoor unit 12 includes an indoor controller 16B configured to control the operation of the corresponding component that constitutes the indoor unit 12 (FIG. 2). In particular, the outdoor controller 16A sends a command signal, which controls driving of the compressor 18 by frequency, to an inverter 46. The inverter 46 controls the capacity of this compressor 18 by frequency by rectifying the voltage of a commercial alternating-current power supply 47, converting a frequency of the rectified voltage into a frequency in accordance with a direct-current signal received from the outdoor controller 16A, and outputting it to the motor of the compressor 18.

The outdoor controller 16A of the outdoor unit 11 exchanges, for example, control signals with the indoor controller 16B of each of the plurality of indoor units 12 via a transmission line 48. That is, the outdoor controller 16A and indoor controllers 16B constitute the controller 16 that controls the entire operation of the air conditioner 10.

This controller 16 receives measurement signals from the pressure sensors 32 and 33 and the various temperature sensors 35 to 39, 43 to 45, and controls, for example, the compressor 18, the four-way valve 19, the outdoor expansion valve 21, the outdoor fan 22, the electromagnetic valve 28, the supercooling expansion valve 31, and the indoor expansion valve 41, the indoor fan 42 on the basis of these measurement signals. In this manner, the controller 16 performs, for example, the cooling operation, the heating operation, and the excessive refrigerant control operation of the air conditioner 10 as described below.

(A) Cooling Operation

During the cooling operation, the four-way valve 19 is controlled by the controller 16 so as to be brought into the state indicated by the solid line in FIG. 1, i.e., the state in which the discharge side of the compressor 18 is connected to the gas side of the outdoor heat exchanger 20, and the suction side of the compressor 18 is connected to the gas side of the indoor heat exchangers 40 via the gas-side packed valve 26 and the gas refrigerant connecting piping 14.

In this state, when the compressor 18, the outdoor fan 22, and the indoor fan 42 are controlled to start by the controller 16, the low-pressure gas refrigerant is sucked into the compressor 18 so as to be compressed and become a high-pressure gas refrigerant. Afterward, the high-pressure gas refrigerant is sent via the four-way valve 19 to the outdoor heat exchanger 20 to exchange heat with the outside air supplied by the outdoor fan 22 and to be condensed into a high-pressure liquid refrigerant. This high-pressure liquid refrigerant passes through the outdoor expansion valve 21, flows into the supercooling heat exchanger 24, and then exchanges heat with the refrigerant flowing through the supercooling bypass circuit 30 so as to be further cooled into a supercooled state.

Part of the refrigerant condensed by the outdoor heat exchanger 20 and cooled by the supercooling heat exchanger 24 is branched so as to flow into the supercooling bypass circuit 30, then is decompressed by the supercooling expansion valve 31, and then is returned to the upper portion of the accumulator 23 on the suction side of the compressor 18.

The high-pressure liquid refrigerant having been brought into a supercooled state by the supercooling heat exchanger 24 is sent to the indoor units 12 via the liquid refrigerant connecting piping 13. The high-pressure liquid refrigerant sent to the indoor units 12 is decompressed to be near the suction pressure of the compressor 18 by the indoor expansion valve 41, becomes a low-pressure gas-liquid two-phase refrigerant, and is sent to the indoor heat exchanger 40. In the indoor heat exchanger 40, the low-pressure gas-liquid two-phase refrigerant exchanges heat with the indoor air to cool the indoor air while evaporates at the same time to turn into a low-pressure gas refrigerant.

This low-pressure gas refrigerant is sent to the outdoor unit 11 via the gas refrigerant connecting piping 14, and flows into the accumulator 23 via the four-way valve 19. The low-pressure gas refrigerant having flowed into the accumulator 23 is sucked into the compressor 18 again.

(B) Heating Operation

During the heating operation, the four-way valve 19 is controlled by the controller 16 so as to be brought into the state indicated by the broken line in FIG. 1, i.e., the state in which the discharge side of the compressor 18 is connected to the gas side of the indoor heat exchangers 40 via the gas-side packed valve 26 and the gas refrigerant connecting piping 14, and the suction side of the compressor 18 is connected to the gas side of the outdoor heat exchanger 20.

Under this state, when the compressor 18, the outdoor fan 22, and the indoor fan 42 are controlled to start by the controller 16, the low-pressure gas refrigerant is sucked into the compressor 18 and compressed so as to become a high-pressure gas refrigerant, and then is sent to the indoor units 12 via the four-way valve 19 and the gas refrigerant connecting piping 14.

The high-pressure gas refrigerant sent to the indoor units 12 exchanges heat with the indoor air in the indoor heat exchangers 40 to heat the indoor air while condenses at the same time to turn into a high-pressure liquid refrigerant, and then is decompressed depending on the opening degree of the indoor expansion valves 41 when passing through the indoor expansion valves 41.

The refrigerant having passed through the indoor expansion valves 41 is sent to the outdoor unit 11 via the liquid refrigerant connecting piping 13, then is further decompressed by passing through the supercooling heat exchanger 24 and the outdoor expansion valve 21, and then flows into the outdoor heat exchanger 20. The low-pressure gas-liquid two-phase refrigerant having flowed into the outdoor heat exchanger 20 exchanges heat with the outside air supplied by the outdoor fan 22 and evaporates to turn into a low-pressure gas refrigerant, then passes through the four-way valve 19, and then flows into the accumulator 23. The low-pressure gas refrigerant having flowed into the accumulator 23 is sucked into the compressor 18 again.

(C) Excessive Refrigerant Control Operation

In a multi-type air conditioner 10 having a plurality of indoor units 12, when the amount of the refrigerant to be filled in the refrigerant circuit 15 is determined with reference to the cooling operation, under connection conditions where the capacity of the indoor heat exchangers 40 is smaller than the capacity of the outdoor heat exchanger 20, the amount of the refrigerant in the refrigerant circuit 15 may become excessive during the heating operation. When the amount of the refrigerant becomes excessive during the heating operation, the heating performance may deteriorate due to an increase in discharge pressure of the compressor 18 and/or an increase in indoor supercooling degree of the indoor units.

So first, the controller 16 acquires the condensation temperature by converting the discharge pressure PD measured by the discharge pressure sensor 32 during the heating operation of the air conditioner 10. Next, the controller 16 calculates the indoor supercooling degree SC from the difference between the above-described condensation temperature and the liquid refrigerant temperature TC2 measured by the indoor liquid-side temperature sensor 44 during the heating operation of the air conditioner 10. Further, the controller 16 determines whether the amount of the refrigerant in the refrigerant circuit 15 is excessive during the heating operation of the air conditioner 10 using at least one of the indoor supercooling degree SC calculated as described above and the actually detected opening degree PLS of the indoor expansion valves 41 as a determination index.

Figure 3:
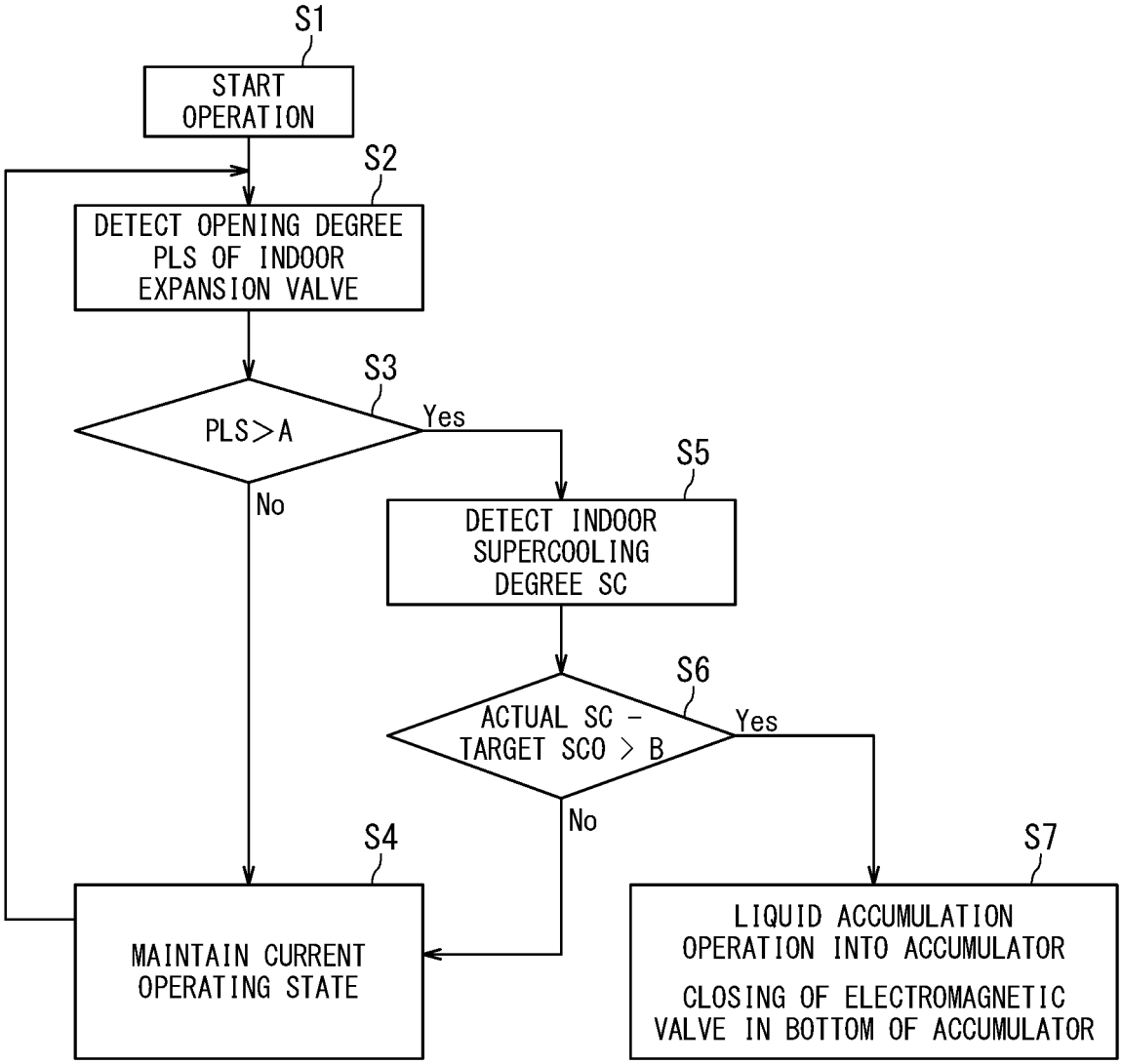
FIG. 3 is a flowchart illustrating determination and control when amount of refrigerant is excessive during heating operation of the air conditioner in FIG. 1.

Specifically, as shown in FIG. 3, the controller 16 starts the air conditioner 10 to perform the heating operation in the step S1, and then detects the opening degree PLS of the indoor expansion valves 41 in the step S2. Next, the controller 16 determines whether the opening degree PLS of the indoor expansion valve 41 is larger than a predetermined opening degree A in the step S3. When the opening degree PLS of the indoor expansion valves 41 are equal to or smaller than the predetermined opening degree A, the controller 16 continues the current operating state in the step S4.

When the opening degree PLS of the indoor expansion valves 41 are larger than the predetermined opening degree A, the controller 16 calculates the indoor supercooling degree SC from the discharge pressure PD of the compressor 18 and the liquid refrigerant temperature TC2 of the indoor heat exchanger 40 in the step S5. Next, the controller 16 determines whether the difference between the indoor supercooling degree SC detected in the step S5 (i.e., actual indoor supercooling degree SC) and the target indoor supercooling degree SCO is larger than a predetermined value B in the step S6.

When the difference between the indoor supercooling degree SC detected in the step S6 and the target indoor supercooling degree SCO is equal to or smaller than the predetermined value B, the controller 16 continues the current operating state in the step S4. When the difference between the indoor supercooling degree SC detected in the step S6 and the target indoor supercooling degree SCO exceeds the predetermined value B, the controller 16 executes a liquid accumulation operation to accumulate refrigerant in the accumulator 23 described below, and closes the electromagnetic valve 28 in the return bypass piping 27 at the bottom portion of the accumulator 23 in the step S7.

The determination on whether the amount of refrigerant in the refrigerant circuit 15 is excessive during heating operation of the air conditioner 10 is made not limited to cases where the two conditions of step S3 (PLS>A) and step S6 (actual SC−target SCO>B) are both met, but also when only the condition of step S3 (PLS>A) is met for a certain period of time or longer, or when only the condition of step S6 (actual SC−target SCO>B) is met for a certain period of time or longer.

In this manner, as shown in the step S7 of FIG. 3, when the amount of the refrigerant in the refrigerant circuit 15 during the heating operation of the air conditioner 10 is determined to be excessive, the controller 16 fully closes the electromagnetic valve 28 of the return bypass piping 27, which connects the bottom portion of the accumulator 23 and the suction side of the compressor 18, and gradually increases the opening degree PLS of the supercooling expansion valve 31 of the supercooling bypass circuit 30, which is the cooling source of the supercooling heat exchanger 24, from a fully closed state so as to store the excessive refrigerant in the accumulator 23.

The present embodiment has the above-described configuration and thus has the following effects.

When the refrigerant in the refrigerant circuit 15 is excessive during the heating operation of the air conditioner 10, the opening degree PLS of the supercooling expansion valve 31 of the supercooling bypass circuit 30 is gradually opened from the fully closed state, and thereby the excessive refrigerant can be stored in the accumulator 23. Further, the refrigerant stored in the accumulator 23 can be kept in the accumulator 23 for a long time by fully closing the electromagnetic valve 28 of the return bypass piping 27. Hence, both the discharge pressure PD on the discharge side of the compressor 18 and the indoor supercooling degree SC of the indoor units 12 can be maintained at appropriate conditions, thereby deterioration of condensation performance of the indoor heat exchanger 40 is prevented, and consequently, satisfactory heating performance of the air conditioner 10 can be ensured.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST

10 air conditioner
11 outdoor unit
12 indoor unit
13 liquid refrigerant connecting piping
14 gas refrigerant connecting piping
15 refrigerant circuit
16 controller
18 compressor
20 outdoor heat exchanger
23 accumulator
24 supercooling heat exchanger
27 return bypass piping
28 electromagnetic valve (valve mechanism)
30 supercooling bypass circuit
31 supercooling expansion valve (supercooling expansion mechanism)
32 discharge pressure sensor
40 indoor heat exchanger
41 indoor expansion valve (indoor expansion mechanism)
44 indoor liquid-side temperature sensor PD discharge pressure
SC indoor supercooling degree
TC2 liquid refrigerant temperature
PLS opening degree of indoor expansion valve

The invention claimed is:

1. An air-conditioner comprising:

a controller;

a refrigerant circuit configured by connecting, via connecting piping:

an outdoor unit including a compressor, an outdoor heat exchanger, an accumulator, and a supercooling heat exchanger, and a plurality of indoor units each including an indoor heat exchanger and an indoor expansion valve configured to adjust an amount of a refrigerant flowing into the indoor heat exchanger, wherein:

the accumulator is connected to a suction side of the compressor, and a bottom portion of the accumulator is connected to a suction side of the compressor via return bypass piping that has a valve;

the outdoor heat exchanger and the supercooling heat exchanger are sequentially connected to a discharge side of the compressor, a cooling source of the supercooling heat exchanger is a supercooling bypass circuit provided with a supercooling expansion valve, the supercooling bypass circuit is configured to expand the refrigerant on a downstream side of the outdoor heat exchanger by the supercooling expansion valve, lead the refrigerant to the supercooling heat exchanger, and then lead the refrigerant to the accumulator;

the controller is configured to determine whether the amount of the refrigerant in the refrigerant circuit is excessive during a heating operation as a determination index in response to at least one of the following cases:

an opening degree of the indoor expansion valve being larger than a predetermined opening degree, and a difference between an indoor supercooling degree detected and a target indoor supercooling degree exceeding a predetermined value; and the controller is configured to fully close the valve of the return bypass piping and gradually increase opening degree of the supercooling expansion valve of the supercooling bypass circuit from a fully closed state in response to determining the amount of the refrigerant in the refrigerant circuit is excessive.

2. The air conditioner according to claim 1, wherein:

the outdoor unit includes a discharge pressure sensor that is provided on the discharge side of the compressor and measures discharge pressure;

each of indoor units include an indoor liquid-side temperature sensor configured to measure liquid refrigerant temperature of the indoor heat; and the controller is configured to calculate condensation temperature from the discharge pressure measured by the discharge pressure sensor during the heating operation, and calculate the indoor supercooling degree from difference between the condensation temperature and the liquid refrigerant temperature of the indoor heat exchanger measured by the indoor liquid-side temperature sensor during the heating operation.

* * * * *